US006546572B2

(12) United States Patent
Demonet

(10) Patent No.: US 6,546,572 B2
(45) Date of Patent: Apr. 15, 2003

(54) BATHTUB AND SHOWER SAFETY APPARATUS

(76) Inventor: Roger R. Demonet, 14276 Eastview Dr., Fenton, MI (US) 48430

( * ) Notice: Subject to any disclaimer, the term of this patent is extended or adjusted under 35 U.S.C. 154(b) by 0 days.

(21) Appl. No.: 09/900,629

(22) Filed: Jul. 6, 2001

(65) Prior Publication Data

US 2002/0002739 A1 Jan. 10, 2002

Related U.S. Application Data

(60) Provisional application No. 60/216,179, filed on Jul. 6, 2000.

(51) Int. Cl.[7] ..... A47K 3/00
(52) U.S. Cl. ..... 4/559; 4/605; 4/580
(58) Field of Search ..... 4/559, 654, 657, 4/658, 580, 605, 290, 291, 292, DIG. 18; 401/201

(56) References Cited

U.S. PATENT DOCUMENTS 1,392,580 A * 10/1921 Landau
1,544,430 A * 1/1925 Brown
4,053,954 A * 10/1977 Chapman
4,117,558 A * 10/1978 Poth
4,956,882 A * 9/1990 Cohn, III
5,207,725 A * 5/1993 Pinkerton ..... 401/201
5,366,125 A * 11/1994 Procido ..... 401/201
5,771,505 A * 6/1998 Reynolds ..... 4/559
5,862,544 A * 1/1999 Placencia ..... 4/597
5,894,612 A * 4/1999 Wilson ..... 4/605
6,067,670 A * 5/2000 Eddy et al. ..... 4/575.1

* cited by examiner

*Primary Examiner*—Charles R. Eloshway
(74) *Attorney, Agent, or Firm*—Plunkett & Cooney, P.C.; Arnold S. Weintraub, Esq.

(57) ABSTRACT

A unitary U-shaped safety enclosure or barrier formed of a resilient and heat and water-resistant material is removably positionable in a bathtub in enclosing relation about the water faucet and valve thereof to prevent access thereto and minimize injuries to a bather, such as arising from a slip or fall, or a child inappropriately adjusting the temperature or water being supplied to the tub, possibly resulting in scalding or the tub to overflow. The safety enclosure includes a central wall that extends above and shields the bather from the water delivery faucet, and a pair of sidewalls that space the central wall from the faucet and have slotted portions for hanging the enclosure. A net-like basket is removably mounted within the U-shaped enclosure for storing bath apparatus and permitting water to drain from the bath apparatus when the enclosure is hung or otherwise removed from the water.

26 Claims, 2 Drawing Sheets

FIG 1
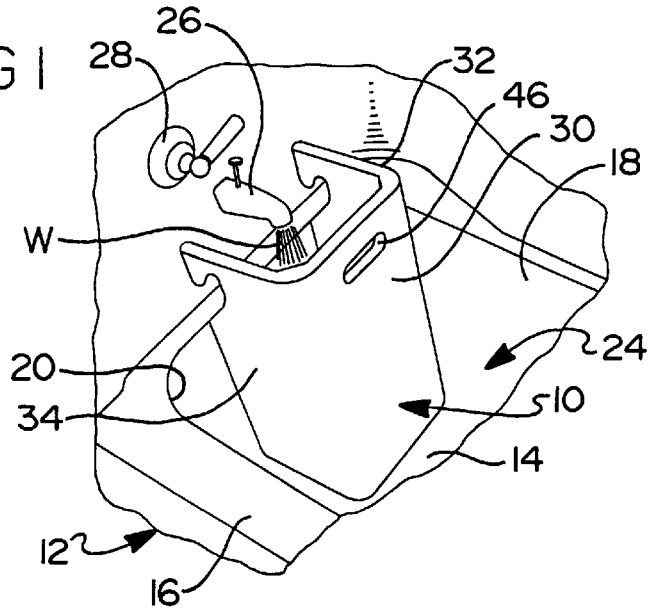
FIG 2
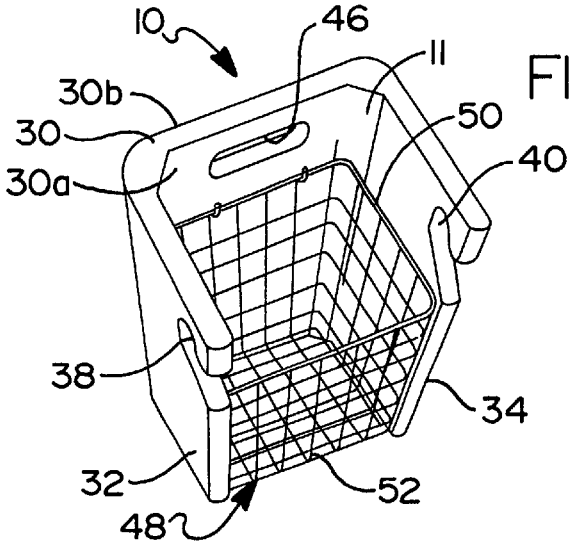
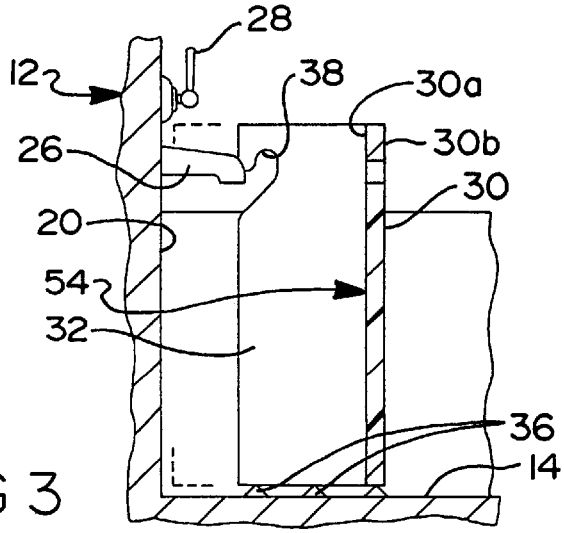
FIG 3

FIG 4A
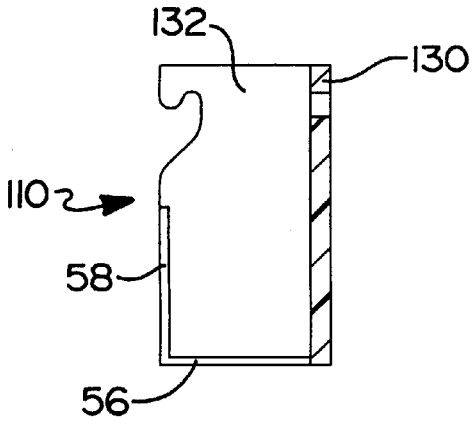
FIG 4B
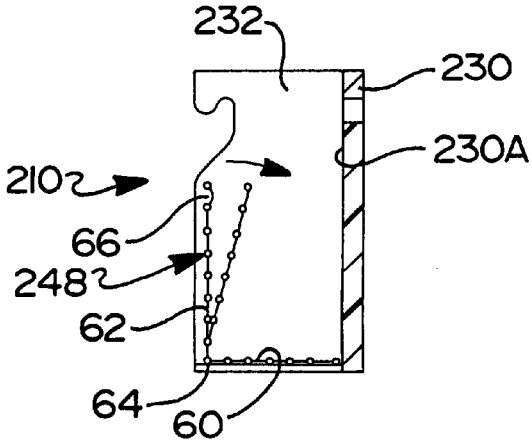
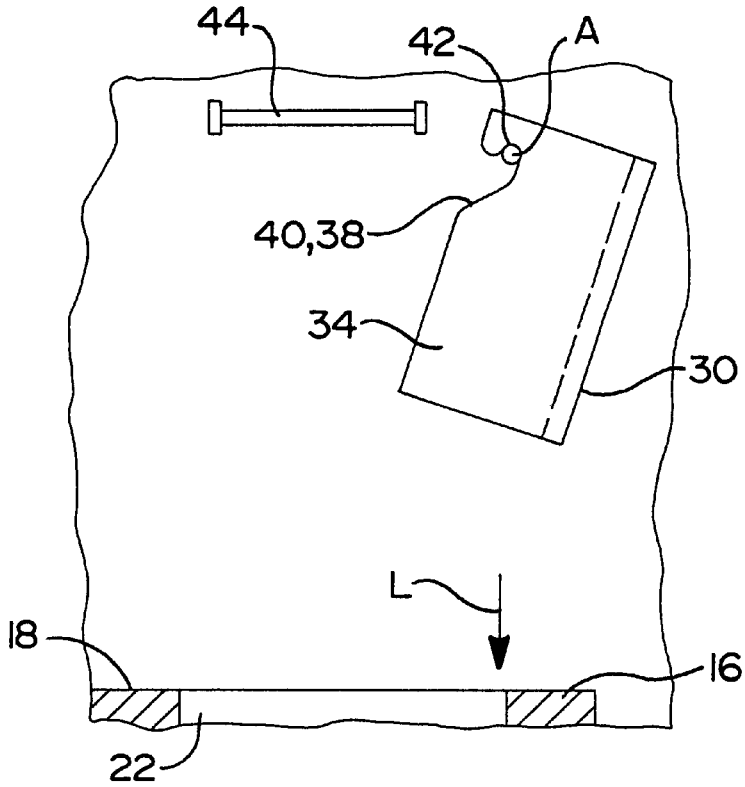
FIG 5

BATHTUB AND SHOWER SAFETY APPARATUS

CROSS-REFERENCE TO RELATED APPLICATIONS

This Application is a completion application based on U.S. Provisional Application Ser. No. 60/216,179, filed Jul. 6, 2000, having the title "Bathtub and Shower Safety Apparatus", the disclosure of which is hereby specifically incorporated herein by reference.

BACKGROUND OF THE INVENTION

1. Field of the Invention

This invention is directed to bathtubs and shower-like enclosures, water control fixtures, and bathtub and shower bracketry and the like. More particularly, this invention is directed to an improved bathtub or shower safety device designed to provide a protective enclosure, shield or barrier between a bather and the water faucet and water control apparatus of the bathtub for protecting a bather in a slip or fall while using the bathtub and from hot scalding water, preventing a child bather from gaining access to the water control knob to thereby inappropriately adjust the amount and/or temperature of the water being supplied to the bathtub, and storing bathing apparatus.

2. Description of Related Art

Bathtubs and shower stalls, and faucets and water delivery fixtures are well known. Generally, bathtubs are constructed of cast iron covered with porcelain, painted or gel coated fiberglass, painted metal, or the like. Oftentimes, the bathtub enclosure forms a portion of a shower stall. Shower stalls are generally similarly constructed and have ceramic tiled floors; and fixtures and water delivery fixtures are protruding metal devices.

It is well known that numerous slip and fall accidents occur in these facilities, as they now exist. Although some of the falls are non-injurious, most result in some injury to or at least result in soft tissue injuries that require no medical attention, while others result in more serious injuries and sometimes even in death of the injured person.

There have been numerous attempts to prevent these slip and fall injuries. A primary approach has been to secure a material having a no-slip surface to the bathtub surface. These strips aid in preventing a person from falling when entering the bathtub. Hand railings can also be of assistance.

Even with these devices in place, an occasional slip and fall accident results causing severe injury while entering, transgressing or exiting a bathtub or shower-like enclosure.

Additionally, little children are particularly susceptible to injury while using the bathtub. Oftentimes, the child is provided with play toys in the bathtub and while standing, or otherwise maneuvering to maintain control of a toy, the child may slip. An injury resulting from this slip and fall can be increased by the head of the child falling against the water faucets and like brackets. Further, the child is susceptible to injury from scalding water should the child decide to turn the hot water valve on.

A primary object of this invention is the provision of an impact-absorbing partition or enclosure for use in the bathtub to form a protective barrier or shield between the bather and the water faucet and water delivery control valve hardware, the enclosure being locatable in enclosing relation about the faucet and control valve.

Another object of this invention is the provision of a safety enclosure that can be detachably secured in enclosing relation about the water control valve and delivery faucet.

Desirably, such partition functions as a safety device to protect a bather from injury resulting from an accidental slip and fall.

Further, the locating of such a partition between the water control and delivery bracketry and the bather will protect a bather, particularly a small child, from being scalded by the hot water being introduced into the bathtub.

An additional object of this invention is the provision of an enclosure, which prevents a child from gaining access to the water control valve and changing the amount or temperature of the water being delivered, the temperature of the water thus mixed, and possibly leading to a condition where the water will overflow the bathtub.

Yet another object of this invention is the provision of an enclosure which functions not only as a protective barrier or shield but also as a toy caddy to store toys and other bathing apparatus, which enclosure may be removed from the bathtub and hung on a shower curtain or towel rod thereabove to enable the bathing apparatus in the caddy to be stored therein for later use, the water to drain therefrom, and the apparatus therein to drip-dry.

SUMMARY OF THE INVENTION

According to this invention there is provided, in combination, a bathtub or shower-like enclosure having a base and upstanding sidewalls, plumbing extending from one of the sidewalls for delivering water to the tub, and a safety bathing device suitable for use in the bathtub for minimizing injuries to a bather arising from a slip or fall and protecting the bather from scalding water. The safety bathing device is removably positionable in the bathtub proximate to the bracketry and comprises:

a generally U-shaped protective barrier, the barrier including a pair of side walls and a protective wall or shield member extending between the sidewalls, said sidewalls forming a protective enclosure and being of a predetermined length sufficient to space the protective wall outwardly from the water delivery hardware and said protective wall being of a predetermined height to position the top of the barrier above the bracketry and at about the same height as the sidewall permitting entry into the bathtub, and the walls of said protective barrier being formed of a suitable material that is resilient, shock absorbing and heat resistant.

According to a preferred embodiment, the protective barrier includes storage means for storing items adapted for use during the bath. In an exemplary form, the storage means comprises a formed mesh net that is removably mountable within the U-shaped enclosure, the mesh net enabling water to circulate therethrough and drain from the barrier when the bath water is emptied from or the barrier stored elsewhere.

Preferably, the U-shaped protective barrier is unitary in construction and lightweight to enable its being lifted, put in place and removed when desired. In an exemplary construction, the protective barrier is of a height extending generally to the height (or rim) of the bathtub sidewalls and the side walls of the barrier are orthogonal to the protective wall to form a U-shaped enclosure shield that is locatable about the bathtub bracketry.

Further and in accordance with the preferred embodiment of the present invention, the barrier includes positioning means for positioning the barrier in position adjacent to the water delivery hardware. The positioning means comprises soft no-slip rubber feet or small vacuum cups along the lower end portions of the barrier walls, which engage the base of the bathtub to help locate and/or secure the barrier in place when it is sitting on the base of the bathtub.

Preferably, the protective barrier is comprised of suitable polymeric or plastic materials such as polyurethane, polyethylene, polyamide, polyimide, polypropylene, polycarbonate, and the like. If desired, the outer periphery of the protective barrier could include a water-resistant laminate.

Advantageously, the barrier operates to prevent the sharp edges of the hardware from causing an injury arising from a slip and fall, and blocks an incoming stream of hot water from splashing on a person preparing a bath.

A benefit of using the barrier to block the incoming stream of hot water is that the barrier will confine the water to the area by the faucet thereby enabling the old and new water to mix and the resultant water temperature to be regulated.

A further benefit of locating the barrier about the water faucet is that the barrier will prevent a small child from being able to reach the water faucet and turn it on or off.

A further advantage of the barrier according to this invention is that it can double as a storage container via a mesh or net-like net basket attached to the inside. Items such as baby toys, tub implements, shampoo, soap, etc. can be contained in the basket, and stored after a bath for later use.

Hooks formed into the body of the U-shaped barrier make it simple and easy to store the barrier after use, i.e., hang from a towel rack or from a shower curtain.

The mesh basket allows materials stored therein to be cleaned (e.g., washed as in a shower so as to prevent scum from remaining on the items) and drip-dry with any water from the stored material simply falling vertically downwardly into the bathtub or shower enclosure.

These and other objects, advantages and benefits of the invention will become apparent to those skilled in the art after considering the following detailed specification in which the preferred embodiment is described in conjunction with the accompanying drawing figures wherein like reference numerals are used.

BRIEF DESCRIPTION OF THE DRAWINGS

FIG. 1 is a perspective view, according to the invention, looking downwardly at a protective barrier for use in a bathtub.

FIG. 2 is a perspective view looking downwardly from the other side of the protective barrier shown in FIG. 1 with the barrier located in a bathtub.

FIG. 3 is a side elevation view of the protective barrier located in the bathtub.

FIGS. 4A and 4B are side views, in section, of alternate structural arrangements for retaining a basket in the protective barrier.

FIG. 5 is a view of the protective barrier in a stored position on a shower curtain rod.

DETAILED DESCRIPTION OF A PREFERRED EMBODIMENT OF THE INVENTION

Turning now to the drawings, FIGS. 1–3 disclose a protective enclosure, barrier, or shield 10 for use in a bathtub 12. Because many bathtubs also function as a shower enclosure or stall, the invention is also applicable to shower enclosures.

The bathtub 12 is conventional and comprises a base or bottom surface 14, a pair of sidewalls 16 and 18, a forward end wall 20 and a rearward end wall 22, the sidewalls and end walls 16, 18, 20, and 22 extending vertically upwardly from the base 14 and forming a chamber 24 for receiving water. The forward end wall 20 is provided with a water faucet 26 to direct water "W" into the bathtub and a water regulator or control valve 28 to provide, and prevent, the entry of water into the bathtub and also to control whether the water is hot or cold. A water drain (not shown) is located below the faucet 26 to empty the water from the bathtub.

The protective enclosure 10 is generally U-shaped in configuration, longitudinally elongated, and comprises a center wall 30 connected to a pair of sidewalls 32 and 34. The U-shaped enclosure defines a U-shaped space or cavity that is sized to enclose the water faucet and water control valve and receive bathing apparatus, in a manner to be described herein below. The interconnection between the walls of the enclosure is such that the sidewalls 32 and 34 are generally parallel to one another and orthogonal to the center wall 30. Preferably, the protective enclosure 10 is integrally formed and is of one-piece construction and may include stiffening material 11 where the walls are joined whereby to inhibit flexure of the U-shaped cross-section.

The walls 30, 32, and 34 are generally dimensioned so that the upper edges of the respective walls are generally proximate to the upward location of the faucet 26 from the base 14 of the bathtub. In the preferred embodiment illustrated in FIG. 3, the faucet 26 and protective enclosure 10 each extend upwardly from the top of the bathtub sidewalls, and the enclosure extend vertically above the faucet 26.

Importantly, the U-shaped enclosure 10 is adapted to completely enclose the bathtub faucet 26 and regulator valve 28. In such use, the protective enclosure 10 is a safety device and functions as a barrier that divides the bathtub whereby to prevent a child on one side of the enclosure from gaining access to the water faucet and water control bracketry on the other side of the enclosure. Advantageously, the child is inhibited from increasing the water flow, such as may lead to overfilling of the bathtub, or the temperature of the water supplied by the faucet. Importantly, the protective enclosure 10 shields the child from the water during its introduction into the tub, as well as allowing the water to mix as it enters the bathtub.

Preferably and according to this invention the protective enclosure 10 is formed of a resilient, shock absorbing, heat resistant foam material. While these materials are known, the enclosure 10 preferably comprises a polymeric material such as polyurethane, polyethylene, polyimide, polyamide, polypropylene, polycarbonate, and the like. If desired, the outer surface the polymer could be provided with a smooth water resistant vinyl laminate.

Further and in accordance with the preferred embodiment of the present invention, the protective enclosure 10 includes positioning means for removably positioning and maintaining the enclosure in enclosing relation around the faucet 26. As shown in FIG. 3, several small vacuum cups 36 are positioned along the bottom edges of the enclosure walls 30, 32, and 34 and engage the base 14 of the bathtub.

Additionally, if desired, soft no-slip rubber feet (not shown) could extend from the lower edge of the protective enclosure 10 to grippingly engage the bottom surface or base 14 of the bathtub to help locate and/or secure the enclosure in place when the enclosure is sitting on the floor of the tub.

The dotted lines in FIG. 3 illustrate the location of the U-shaped enclosure 10 if the vertical edges of the sidewalls 32 and 34 are positioned substantially against the vertical front wall 20 of the bathtub. The sidewalls 32 and 34 can be suitably dimensioned to enable the enclosure lo to be substantially simultaneously positioned as desired about the faucet 26 and the vacuum cups (or rubber feet) connected to or otherwise engaged with the bathtub.

To simplify storage of the protective enclosure 10 after use, a portion of each respective sidewall 32 and 34 is cutout or otherwise has material removed to form an elongated outwardly open slot portion or hook 38 and 40. As shown in FIG. 5, the hooks or slot portions 38 and 40 are attached or removably mounted to a longitudinally extending support rod 42 above the sidewall or entry side 16 of the bathtub, causing the protective enclosure 10 to be disposed at an acute angle to a vertical arrow shown at "L". The rod 42 could take the form of a shower curtain rod or a towel rack 44.

The center wall or shield 30 of the protective enclosure 10 may be provided with an elongated cutout 46 adjacent to the top edge thereof, the cutout extending between the opposite faces 30a and 30b of the center wall or shield and functioning as a handle to enable the protective enclosure 10 to be lifted from the bathtub and moved elsewhere, such as for storage on the rods 42 and 44.

Alternatively, although not shown in the drawings, a handle, finger gripping detent, or other suitable grasping structure can be integrally formed with the enclosure hereof, such as by molding and the like.

Further and in accordance with an important aspect of this invention the protective enclosure 10 is provided with an open mesh (or net) basket 48. As shown in FIG. 2, the basket 48 is generally rectangular in shape, upwardly open, and comprises a semirigid frame 50 or the like and an array of stringers 52 which form the basket or netting shape. It should be noted that the top stringer may define the frame by being stretched taut.

The basket 48 is removably secured to the center wall or shield 30 by latches or hooks 54 that extend from the inner surface 30a of the center wall and engage the frame 50. The mesh basket 48 functions as a caddy to contain items such as baby toys, tub implements, shampoo, soap, etc. used during a bath and also as a place to store these items after a bath for later use.

Desirably, the mesh basket 48 allows materials stored therein to drip-dry with any water from the stored material simply falling vertically downwardly from the basket 48 and into the bathtub.

As shown in FIG. 5, the enclosure 10 has been connected to the shower curtain rod 42 by the hooks 38 and 40. In this connection, the protective enclosure or safety device 10 is free to rotate or otherwise swing relative to the longitudinal axis "A" of the rod 42. Due to the fact that the mass center of the protective enclosure 10 and the axis of rotation are offset to one another, the force of gravity will cause the bottommost corner of the protective enclosure 10 to rotate into position vertically above the sidewall 16 or entry side of the bathtub. Water from the basket will drain from the bottommost portion of the enclosure wall 30 vertically downwardly and into the tub in the direction of the arrow "L".

The invention could be modified from that as described hereinabove. For example, FIGS. 4A and 4B disclose U-shaped safety devices, protective enclosures, or partitions 130 and 230, partially in section, and variations in arrangements for removably mounting a mesh basket for storing bath items. As before, the storage basket is dimensioned to clearance fit with in the U-shaped space formed by the walls of the U-shaped enclosures and the enclosure is provided with structure for supporting, captivating and inhibiting unwanted release of the basket from the enclosure.

In FIG. 4A, the U-shaped enclosure 110 includes a central wall or shield 130 and a pair of sidewalls 132. An L-shaped flange projects from each sidewall, each of the flanges being in register with one another. Each flange includes an elongated leg or lip 56 that extends along the lower edge of each sidewall 132, the lips 56 providing a horizontal support for supporting the bottom of the basket 48. Each flange also includes an elongated leg or lip 58 that extends along the vertical edge of each sidewall 132, the lips 58 providing a retention for preventing the basket 48 from falling out of the U-shaped enclosure.

In FIG. 4B, the U-shaped enclosure 210 includes a central wall or shield 230 and a pair of sidewalls 232, and a mesh basket 248 removably mounted inside the U-shaped enclosure. The mesh basket 248 is L-shaped and includes a first leg 60 and a second leg 62. The basket 248 is similar to that described above and includes a peripheral frame and an array of stringers. A longitudinally extending lip 64 extends along the lower edge of each sidewall 232, the lips 64 providing a horizontal support for supporting the first leg (i.e., the bottom) 60 of the basket 248. Each sidewall 232 is also provided with a latch (or hook) 66 for engagement with the frame of the second leg 62 of the basket 248. The free end of the first leg 60 abuts the shield wall 230*a* and the free end of the second leg 62 is adapted to flex towards and away from the shield 230. When the first leg 62 flexes away from the shield wall 230*a,* the free end thereof engages the latches 66. When the first leg 62 flexes towards the shield wall 230*a* and from engagement with the latches 66, the basket 248 can be removed.

Although various embodiments of the invention have been disclosed for illustrative purposes, it is understood that one skilled in the art can make variations and modifications without departing from the scope of the invention.

For example, attachment suction cups are shown being provided on the bottom of the barrier. The suction cups could be provided along the vertically disposed edges of the sidewalls facing towards the front wall of the bathtub. In such arrangement, the forward facing edges of the sidewalls of the U-shaped barrier would detachably connect to the front wall of the bathtub. Of course, no suction cups are needed. The apparatus or device hereof may simply seat on the bottom or base of the tub or shower.

With respect to the above description, then, it is to be understood that the optimum dimensional relationships for the parts of the invention, to include variations in size, materials, shape, form, function and manner of operation, assembly and use, are deemed to be readily apparent to skilled in the art, and all equivalent relationships to those illustrated in the drawings and described in the specification are intended to be encompassed by the present invention.

Having thus described the invention, what is claimed is:

What is claimed is:

1. A bathtub safety device for use in a bathtub having a bottom surface, a forward end wall wherein bracketry comprising a water faucet and water control valve are provided, an entry side defining a first wall, and a backside defining a second wall, the walls extending vertically upwardly from the bottom surface, the safety device comprising:

a generally U-shaped protective enclosure adapted to be operably positioned on the bottom surface of the bathtub between the first and second walls thereof and in enclosing relation about the bracketry, the protective enclosure including a pair of sidewalls adapted to be placed in confronting relation with the respective first and second walls and a central wall extending between the sidewalls, the sidewalls being adapted to space the central wall from the bracketry and the central wall being of a predetermined dimension adapted to extend above the bracketry, the walls of the protective enclosure being formed of a suitable material that is resilient, shock absorbing and resistant to heat and water penetration.

2. The invention as claimed in claim 1 wherein the protective enclosure includes means for storing items adapted for use during the bath.

3. The invention as claimed in claim 2 wherein the means for storing comprises a formed mesh net that is removably mountable within the U-shaped space formed by the walls of the protective enclosure, the mesh net enabling water to circulate therethrough and drain from the enclosure when the water is emptied from the bathtub or the enclosure is stored elsewhere.

4. The invention as claimed in claim 3, wherein:

the mesh net comprises a plurality of interconnected spaced apart stringers formed into a generally rectangular shaped upwardly open basket, and further comprising:

means for mounting the basket to at least one wall of the enclosure such that the upwardly open end of the basket is accessible from the top end portion of the enclosure.

5. The invention as claimed in claim 4, wherein the means for mounting comprises a hook member extending inwardly into the U-shaped space formed by the enclosure sidewalls, the hook engaging at least one of said stringers.

6. The invention as claimed in claim 4, wherein the means for mounting comprises the confronting surfaces of the sidewalls each being provided with an L-shaped ledge for captivating and inhibiting unwanted removal of the basket, the ledges having first and second legs, respectively, extending horizontally for supporting the basket and vertically for inhibiting movement of the basket outwardly of the enclosure.

7. The invention as claimed in claim 3, wherein:

the mesh net comprises a plurality of interconnected spaced apart stringers that are formed into an L-shaped support member having first and second legs, the support member having a width dimensioned to enable the support member to clearance fit between the respective sidewalls, and means for mounting the support member to the enclosure, said means for mounting comprising the confronting surfaces of each said sidewall being provided with a support lip extending horizontally when the enclosure is supported on the bottom surface for supporting one leg of the support member and at least one sidewall being provided with a retention member, the retention member being spaced from the lip associated therewith and operable to releasably retain the other leg of the support member.

8. The invention as claimed in claim 1, wherein the U-shaped enclosure is unitary in construction and lightweight to enable its being lifted, put in place and removed when desired.

9. The invention as claimed in claim 1, wherein:

the sidewalls are generally orthogonal to the central wall and define a U-shaped space dimensioned to enclose the bathtub bracketry, and the sidewall of the enclosure proximate to the first wall defining the entry side of the bathtub has upper and lower ends and is dimensioned such that the upper end of the sidewall extends above the upward extension of the entry side of the bathtub when the lower end of the sidewall is proximate to the bottom surface of the bathtub, the protective enclosure being positionable between the bather and the bracketry whereby to shield the bather from the bathtub bracketry.

10. The invention as claimed in claim 9, further comprising means for stiffening the enclosure to inhibit the sidewalls from flexing relative to their connection to the center wall, the means for stiffening comprising an elongated, generally linearly extending, strip of material extending along the respective junctions between each sidewall and center wall.

11. The invention as claimed in claim 9, wherein the sidewalls define exterior surfaces that are generally parallel to one another and the respective first and second walls and dimensioned to generally clearance fit between the sidewalls when the enclosure is supported on the bottom surface.

12. The invention as claimed in claim 1, further comprising means for removably securing and positioning the protective enclosure to the bathtub in enclosing juxtaposition about and adjacent to the bracketry.

13. The invention as claimed in claim 12 wherein the means for removably securing and positioning comprises vacuum suction cups along the lower ends of the enclosure sidewalls, the suction cups grippingly engaging the bottom surface of the bathtub when the enclosure is supported thereon whereby to immovably locate and/or secure the enclosure relative to the bottom surface of the bathtub.

14. The invention as claimed in claim 12 wherein the means for removably securing and positioning comprises soft no-slip rubber strips along the lower ends of the sidewalls, the strips grippingly engaging the bottom surface of the bathtub when the enclosure is supported thereon whereby to immovably locate and/or secure the enclosure relative to the bottom surface of the bathtub.

15. The invention as claimed in claim 1, wherein the walls of the protective enclosure are comprised of a polymeric material selected from a group consisting of polyurethane, polyethylene, polyamide, polyimide, polypropylene, and polycarbonate.

16. The invention as claimed in claim 1, wherein a water resistant laminate is provided on the exterior surfaces of the protective enclosure.

17. The invention as claimed in claim 1, the sidewalls having a pair of aft edges that define ends of the generally U-shaped protective enclosure, wherein at least one of the sidewalls is cutout to form a hook-like portion that extends inboard of the aft edge of the sidewall and that enables the protective enclosure to be hung from a support bar after use.

18. The invention as claimed in claim 1, further comprising means for handling the protective enclosure, the means for handling including the central wall being provided with a cutout portion sized to receive a hand inserted therein.

19. A bathtub safety device attachable to the bottom surface of floor mounted bathtub having a pair of sidewalls and a forward wall substantially vertically disposed to the bottom surface and a water delivery faucet and control valve extending from the forward wall, the safety device comprising:

a U-shaped enclosure, the enclosure defining a U-shaped cavity extending longitudinally and sized to enclose the water faucet and valve, means for securing the enclosure to the bathtub in such manner that the enclosure is in enclosing relation about the faucet and valve, disposed between the sidewalls of the bathtub, and extending substantially vertically relative to the bottom surface of the bathtub, a removable net-like storage member, and means for removably mounting the storage member to said enclosure.

20. The invention as claimed in claim 19, wherein:

said enclosure is unitary and formed of a resilient water resistant material, the walls of said enclosure extending vertically above the sidewalls of said bathtub and above the faucet and valve when the enclosure is mounted to the bottom surface, and the enclosure dividing the bathtub and separating the bather from the faucet and valve, and said means for securing comprises the walls of said enclosure being provided with suction cups which removably engage with at least one said bottom surface, front wall and sidewall of the bathtub.

21. A bathtub safety device for use in a bathtub having a bottom surface, a forward end wall having a water faucet and water control valve, an entry side defining a first wall, and a backside defining a second wall, the walls extending vertically upwardly from the bottom surface, the safety device comprising:

a generally U-shaped protective enclosure positionable on the bottom surface of the bathtub between the first and second walls thereof and in enclosing relation about the bracketry, the protective enclosure including a pair of sidewalls adapted to be placed in confronting relation with the respective first and second walls and a central wall extending between the sidewalls, the sidewalls being adapted to space the central wall from the bracketry and the central wall being of a predetermined dimension adapted to extend above the bracketry, the walls of the protective enclosure being formed of a suitable material that is resilient, shock absorbing and resistant to heat and water penetration, and a means for storing items adapted for use during a bath, the means for storing comprising a formed mesh net that is removably mountable within the U-shaped space formed by the walls of the protective enclosure, the mesh net enabling water to circulate there through and drain from the enclosure when the water is emptied from the bathtub or the enclosure is stored elsewhere.

22. The invention as claimed in claim 21, wherein:

the mesh net comprises a plurality of interconnected spaced apart stringers formed into a generally rectangular shaped upwardly open basket, and further comprising:

means for mounting the basket to at least one wall of the enclosure such that the upwardly open end of the basket is accessible from the top end portion of the enclosure.

23. The invention as claimed in claim 22, wherein the means for mounting comprises a hook member extending inwardly into the U-shaped space formed by the enclosure sidewalls, the hook engaging at least one of the stringers.

24. The invention as claimed in claim 22, wherein the means for mounting comprises the confronting surfaces of the sidewalls each being provided with an L-shaped ledge for captivating and inhibiting unwanted removal of the basket, the ledges having first and second legs, respectively, extending horizontally for supporting the basket and vertically for inhibiting movement of the basket outwardly of the enclosure.

25. The invention as claimed in claim 21, wherein:

the mesh net comprises a plurality of interconnected spaced apart stringers that are formed into an L-shaped support member having first and second legs, the support member having a width dimensioned to enable the support member to clearance fit between the respective sidewalls, and means for mounting the support member to the enclosure, the means for mounting comprising the confronting surfaces of each the sidewall being provided with a support lip extending horizontally when the enclosure is supported on the bottom surface for supporting one leg of the support member and at least one sidewall being provided with a retention member, the retention member being spaced from the lip associated therewith and operable to releasably retain the other leg of the support member.

26. A bathtub safety device for use in a bathtub having a bottom surface, a forward end wall comprising a water faucet and water control valve, an entry side defining a first wall, and a backside defining a second wall, the walls extending vertically upwardly from the bottom surface, the safety device comprising:

a generally U-shaped protective enclosure positionable on the bottom surface of the bathtub between the first and second walls thereof and in enclosing relation about the bracketry so as to shield a bather from the bathtub bracketry, the protective enclosure including a pair of sidewalls adapted to be placed in confronting relation with the respective first and second walls and a central wall extending between the sidewalls, the sidewalls being generally orthogonal to the central wall to define a U-shaped space dimensioned to enclose the bathtub bracketry and further adapted to space the central wall from the bracketry, and means for stiffening the enclosure to inhibit the sidewalls from flexing relative to their connection to the center wall, the means for stiffening comprising an elongated, generally linearly extending, strip of material extending along the respective junctions between each sidewall and center wall, wherein the sidewall of the enclosure proximate to the first wall defining the entry side of the bathtub has upper and lower ends and is dimensioned such that the upper end of the sidewall extends above the upward extension of the entry side of the bathtub when the lower end of the sidewall is proximate to the bottom surface of the bathtub and the central wall being of a predetermined dimension adapted to extend above the bracketry, the walls of the protective enclosure being formed of a suitable material that is resilient, shock absorbing and resistant to heat and water penetration.

* * * * *